US008839718B2

(12) United States Patent
Wiener et al.

(10) Patent No.: US 8,839,718 B2
(45) Date of Patent: Sep. 23, 2014

(54) ERROR CORRECTION IN PRINTING SYSTEMS

(75) Inventors: Ittai Wiener, Even Yehuda (IL); Dima Vais, Rehovot (IL); Maxim Bramnik, Netanyah (IL); Israel Lasker, Kfar Saba (IL); Ayal Galili, Beit Elazari (IL); Alex Feygelman, Petach-Tiqwa (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1314 days.

(21) Appl. No.: 12/410,814

(22) Filed: Mar. 25, 2009

(65) Prior Publication Data

US 2010/0247116 A1 Sep. 30, 2010

(51) Int. Cl.
*B41F 5/02* (2006.01)
*G03G 15/23* (2006.01)

(52) U.S. Cl.
CPC .... *G03G 15/234* (2013.01); *G03G 2215/00679* (2013.01); *G03G 2215/00438* (2013.01)
USPC ..... 101/229; 101/408; 101/485

(58) Field of Classification Search
USPC ..... 101/229–231, 408, 409, 484, 485, 490; 271/3.22, 3.23, 241
See application file for complete search history.

(56) References Cited

U.S. PATENT DOCUMENTS

| | | | | | |
|---|---|---|---|---|---|
| 4,186,662 | A * | 2/1980 | Borneman | 101/218 |
| 4,621,801 | A * | 11/1986 | Sanchez | 271/251 |
| 4,986,526 | A * | 1/1991 | Dastin | 271/227 |
| 5,213,036 | A * | 5/1993 | Tokuno et al. | 101/232 |
| 5,333,547 | A * | 8/1994 | Pfisterer et al. | 101/409 |
| 5,552,875 | A * | 9/1996 | Sagiv et al. | 399/364 |
| 5,937,805 | A | 8/1999 | Matsumura | |
| 5,988,784 | A | 11/1999 | Takemura et al. | |
| 6,179,419 | B1 * | 1/2001 | Rasmussen et al. | 347/104 |
| 6,823,786 | B1 * | 11/2004 | Shmaiser et al. | 101/231 |
| 6,851,672 | B1 * | 2/2005 | Shmaiser et al. | 271/276 |
| 6,912,952 | B1 | 7/2005 | Landa et al. | |
| 7,234,395 | B2 * | 6/2007 | Forch et al. | 101/232 |
| 7,481,429 | B2 * | 1/2009 | Eckart et al. | 271/275 |
| 8,059,991 | B2 * | 11/2011 | Andoh et al. | 399/167 |
| 2002/0031279 | A1 * | 3/2002 | Shimizu | 382/291 |
| 2002/0063381 | A1 * | 5/2002 | Henn | 271/226 |
| 2003/0123755 | A1 * | 7/2003 | Shimizu | 382/291 |

(Continued)

FOREIGN PATENT DOCUMENTS

JP 2004187413 A * 7/2004 ..... H02P 8/12

OTHER PUBLICATIONS

Translation of JP 2004/187,413.*

(Continued)

*Primary Examiner* — David Banh

(57) ABSTRACT

A method of error correction in a printing system includes engaging a sheet of print media with a perfector arm and detecting a relative position of the perfecter arm with respect to the sheet of print media when the perfecter arm has engaged the sheet of print media, the detecting being performed using a homing sensor that is configured to sense the perfecter arm while the perfecter arm is engaged with the sheet of print media. The relative position of the perfecter arm with respect to the sheet of print media is compared with an expected relative position and any difference between the relative position and expected relative position is compensated for when feeding the sheet of print media with the perfector arm to a print engine.

20 Claims, 10 Drawing Sheets

(56) References Cited

U.S. PATENT DOCUMENTS

| | | | | |
|---|---|---|---|---|
| 2004/0098857 | A1* | 5/2004 | Kawada | 29/740 |
| 2005/0042001 | A1* | 2/2005 | Shinohara et al. | 399/301 |
| 2005/0097940 | A1* | 5/2005 | Strasser et al. | 72/420 |
| 2005/0126411 | A1* | 6/2005 | Forch et al. | 101/408 |
| 2007/0006754 | A1* | 1/2007 | Eckart et al. | 101/232 |
| 2007/0212149 | A1* | 9/2007 | Ota et al. | 400/208 |
| 2009/0219553 | A1* | 9/2009 | Sutoh | 358/1.9 |

OTHER PUBLICATIONS

Hewlett-Packard Company; "HP Indigo Press 5500"; Brochure; p. 1-8; http://h10010.www1.hp.com/wwpc/pscmisc/vac/us/product_pdfs/3382246.pdf.

* cited by examiner

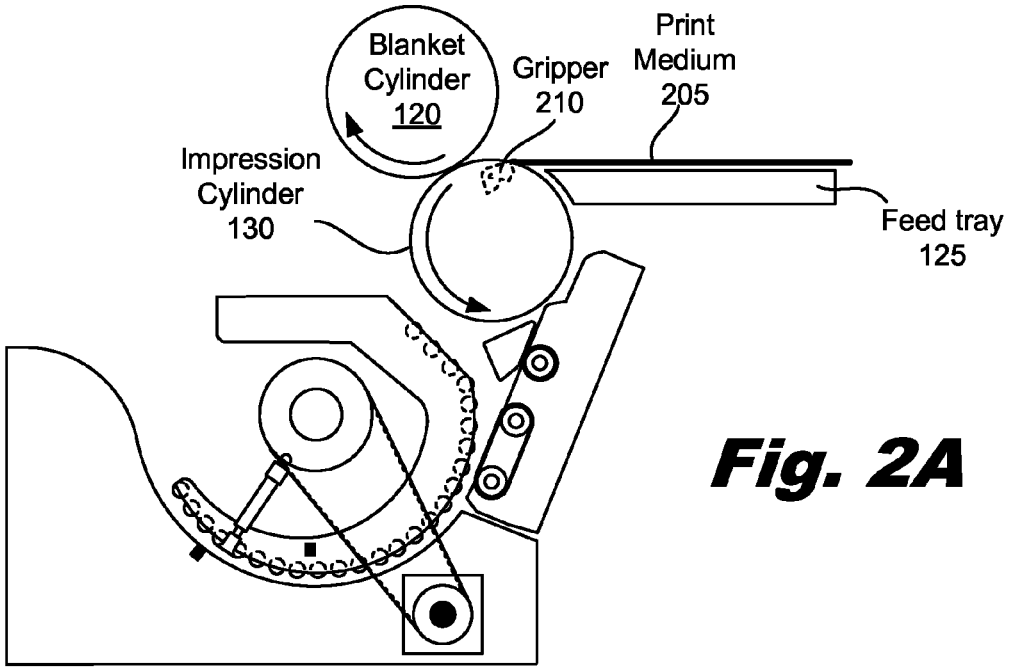
Fig. 2A
Fig. 2B
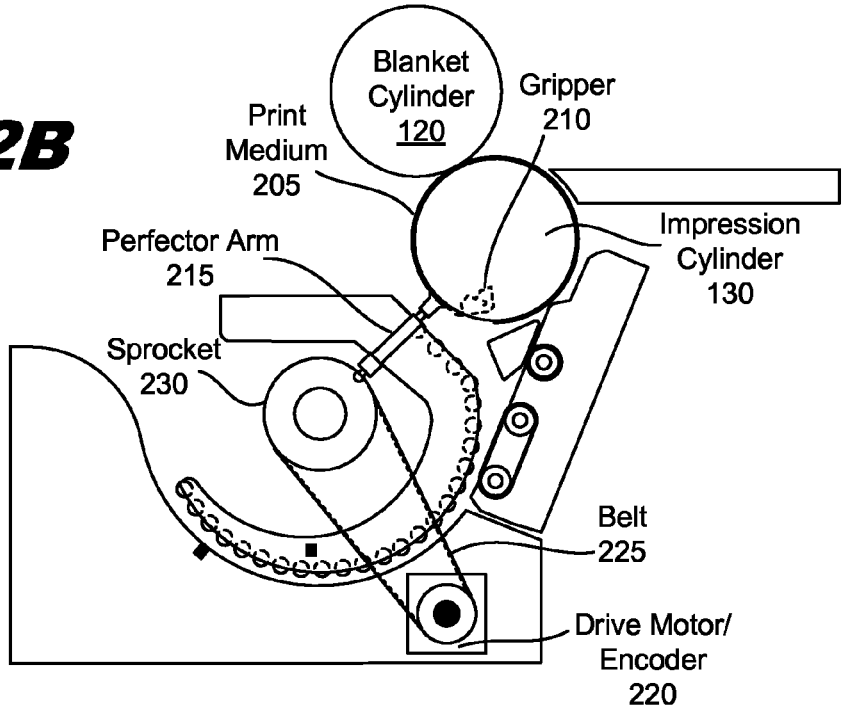

ERROR CORRECTION IN PRINTING SYSTEMS

BACKGROUND

Error correction within high precision positioning systems can compensate for imperfections within the system and produce more precise results. For example, printers use a number of high precision positioning devices to precisely place ink on a sheet of print media. To precisely place ink on the sheet of print media, it is desirable that the relative position of the ink delivery device and the sheet of print media be accurately controlled. For example, a duplexing printer first applies an image to the first side of a sheet of print media, then flips the sheet over and prints an image on the opposite side of the sheet. A measure of the quality of the duplex printing process is the accurate registration of the back image with respect to the front image. Accurate registration is needed so that books and folders containing a picture that is divided on two pages connect in such a way that the image appears well aligned to the reader. For this reason, it is desirable that front (simplex side) to back (duplex side) registration should be very precise.

BRIEF DESCRIPTION OF THE DRAWINGS

The accompanying drawings illustrate various embodiments of the principles described herein and are a part of the specification. The illustrated embodiments are merely examples and do not limit the scope of the claims.

FIGS. 2A-2F are diagrams of an illustrative positioning system accepting and manipulating a sheet of print media during a duplex printing process, according to one embodiment of principles described herein.

Throughout the drawings, identical reference numbers designate similar, but not necessarily identical, elements.

DETAILED DESCRIPTION

Printers use a number of high precision positioning devices to precisely place ink on a sheet of print media. To precisely place ink on the sheet, it is desirable that the relative position between the ink delivery device and the sheet be accurately controlled. For example, the motion of a print carriage over a sheet during the printing process should be accurate and repeatable so that the desired image is formed on the sheet of print media.

In another example, a printer first applies an image to the first side of a sheet of print media, then inverts the sheet and prints an image on the opposite side of the sheet. This process is generally referred to as duplex printing. A measure of the quality of the duplex printing process is the accuracy of the registration of the back image with respect to the front image. Accurate registration is needed so that books and folders containing a picture that is divided on two pages connect in such a way that it doesn't disturb the reader. For this reason front (simplex side) to back (duplex side) registration should be very tight.

Accordingly, the present application describes systems and methods in which the position of a perfector arm that is used to transport a sheet of print media between printing a first side and printing a second side is detected relative to the sheet of print media so that any difference from an expected positional relationship between the perfecter arm and print media can be compensated as the sheet is feed to the print engine for printing on the second side. A homing sensor is used to detect the presence of the perfecter arm as the perfector arm engages the print media.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
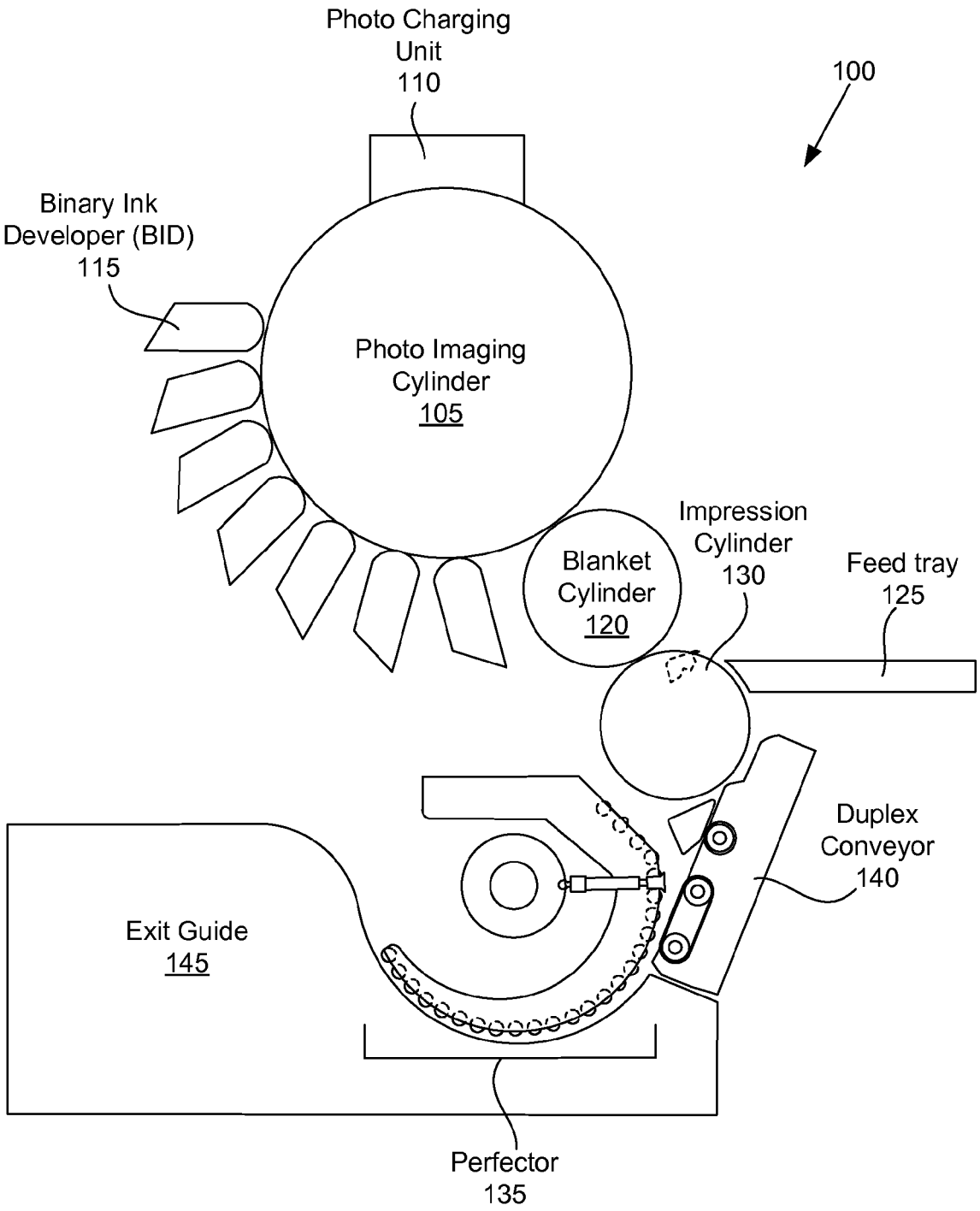
FIG. 1 is a diagram of one illustrative embodiment of a high precision positioning system within a printer, according to one embodiment of principles described herein.

FIG. 1 is a diagram of one illustrative embodiment of a duplex printing system (100). The desired image is initially formed on the photo imaging cylinder (105). The desired image may be text, pictures, black/white images, partial color, full color images, or any combination of text and images. According to one illustrative embodiment, the photo charging unit (110) charges portions of the photo imaging cylinder (105) which correspond to a first color of ink which makes the desired image. A first binary ink developer (115) presents a uniform surface of ink to the photo imaging cylinder (105). The charged portions of the photo imaging cylinder (105) attract the ink and form the desired in k pattern on the photo imaging cylinder (105). This ink pattern is transferred to the blanket cylinder (120).

The sheet of print media enters the printing system (100) from the right, passes over the feed tray (125), and is wrapped onto the impression cylinder (130). The blanket cylinder (120) transfers the ink pattern to the sheet as the sheet passes between the blanket cylinder (120) and the impression cylinder (130). To form a single color image (such as a black and white image), one pass through the impression cylinder (130) and blanket cylinder (120) completes the desired image. For a multiple color image, the sheet is retained on the impression cylinder and makes multiple contacts with the blanket cylinder (120). At each contact, an additional color is placed on the sheet of print media. For example, to generate a four color image, the photo charging unit (110) forms a second pattern on the photo imaging cylinder (105) which receives the second ink color from a second binary ink developer. As described above, this second ink pattern is transferred to the blanket cylinder (120) and impressed onto the sheet as it continues to rotate with the impression cylinder (130). This continues until the desired image is formed on the sheet of print media.

After the desired image is formed on a single sided print, the impression cylinder (130) passes the printed sheet to the perfecter (135) which moves the sheet to the exit guide (145). For double-sided prints, the perfecter (135) and duplex conveyor (140) perform the more complex task of reversing the sheet and reintroducing the sheet to the impression cylinder so that the blank surface of the sheet is on the outside of the impression cylinder (130) to receive the second image. Inaccuracies in performing the duplex processing result in registration errors between the images on the front and back sides of the sheet. For example, when the perfecter feeds the sheet onto the drum imprecisely, the second image is incorrectly placed on the back side of the sheet. When significant errors occur, a visible discontinuity in image placement between facing pages in a book or folder can be disturbing to the reader. For example, when a picture is divided across two pages, image displacements can be particularly noticeable.

Figure 2C:
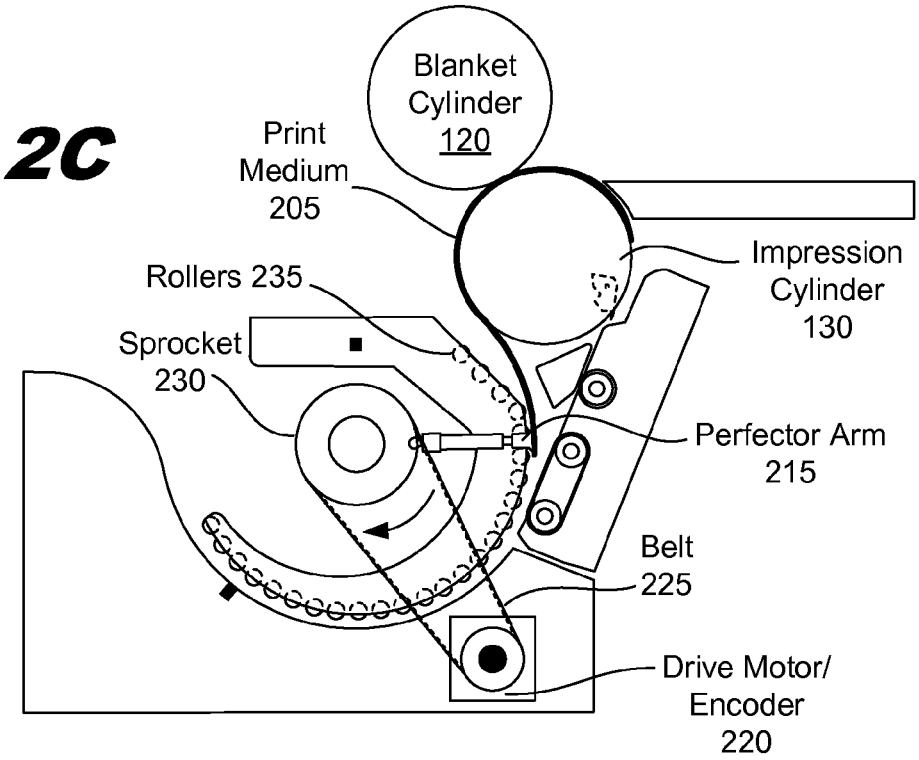

FIGS. 2A-2F are diagrams which provide more detail about the illustrative mechanisms and process flow of duplex printing. FIG. 2A is a diagram which shows the sheet of print media (205) entering the duplex printing system (100). As discussed above, the sheet (205) passes over the feed tray (125). The sheet (205) contacts the impression cylinder (130) and is guided into a gripper mechanism (210) which grips the leading edge of the sheet (205). The impression cylinder (130) continues its rotation and draws the sheet into contact with the tangent portion of the blanket cylinder (120). The impression cylinder may use a variety of techniques and mechanisms to hold the sheet of print media to its outer surface as it rotates. For example, in addition to the gripper (210), the impression cylinder (130) may use a number of vacuum ports which create a pressure differential which holds the sheet (205) onto the outer surface of the impression cylinder (130). As discussed above, the sheet (205) continues to rotate on the outer surface of the impression cylinder (130) until all of the inks are applied to form the desired image on the front surface of the sheet (205).

When the image on the front surface of the sheet of print media (205) has been formed, the sheet is removed from the impression cylinder (130). As shown in FIG. 2B, after the perfector (215) arm has gripped the leading edge, the gripper (210) releases the leading edge. According to one illustrative embodiment, the perfecter arm (215) is attached to a sprocket (230). The motion of the sprocket (230) controlled by a drive motor (220) which is attached to the sprocket by a belt (225). The drive motor (220) has an integral encoder which senses the angular position of the drive motor (220). As used in the specification and appended claims, the term "perfecter arm" refers to a mechanism which lifts printing media from a drum and assists in presenting the opposite side of the printing media for printing within a duplex printer. The term "duplexing process" refers to the steps required to manipulate printing media, after printing on a first side, to present an opposite side of the printing media for printing to produce printed document with printing on both sides of the print media.

To pick up the sheet (205) from off the impression cylinder (130), the drive motor (220) is rotated such that the sprocket (230) and attached perfecter arm (215) rotate to bring a suction surface on the end of the perfecter arm (215) into contact with the front surface of the sheet (205). The suction surface on the end of the perfecter arm (215) lifts the sheet (205) from the impression cylinder (130). Ideally, the perfecter arm (215) repeatably and precisely picks up the sheet from the impression cylinder. However, there may be some amount of error in the pickup process, either because of an error in positioning of the perfecter arm, an error in positioning of the paper, or a combination of both. For example, various sheets may interact differently with the suction cup because of variations in surface quality. Additionally, various tolerances and limitations of the system, such as limitations in encoder resolution, speeds, diameters, positional errors of within the control system, undesirable positioning of the sheet of print media on the impression cylinder, and other factors can result in pickup errors. Pickup errors can result in image registration errors because pickup errors can result in the sheet being incorrectly positioned on the duplex conveyor and impression cylinder.

Figure 2D:
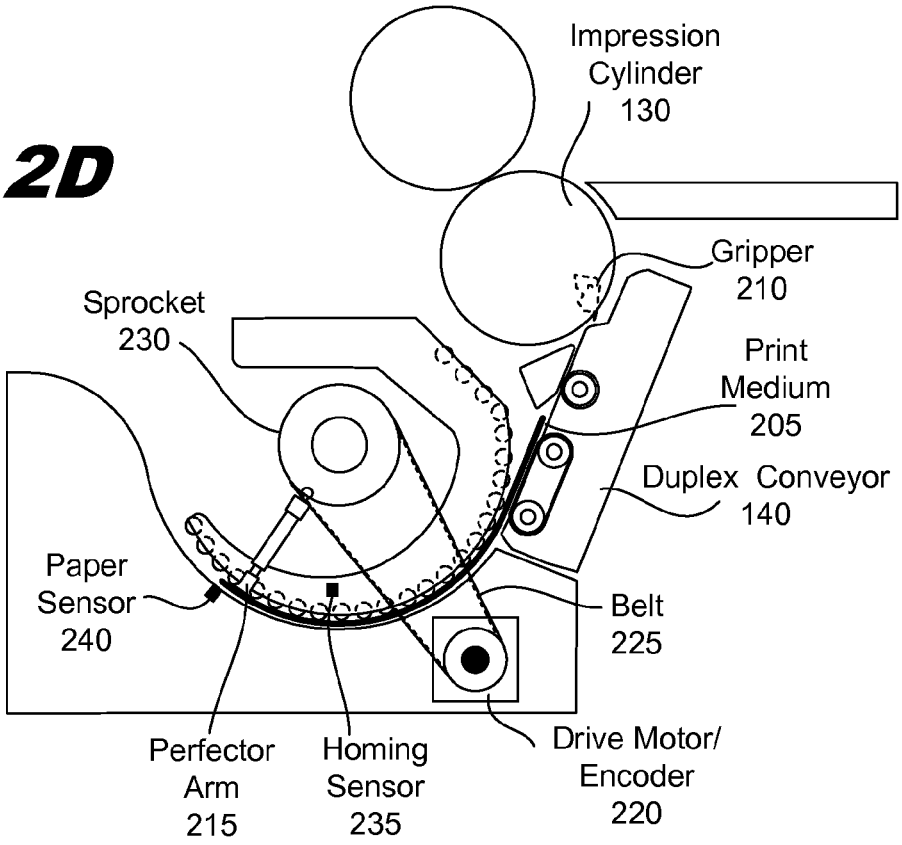

FIG. 2C shows the drive motor (220) continuing to rotate the sprocket (230) and move the sheet into the perfecter and over the rollers (235). FIG. 2D shows the perfecter arm (215) continuing to rotate until the leading edge of the sheet (205) triggers a paper sensor (240). According to one illustrative embodiment, the paper sensor (240) may include a light source and a detector. When the sheet passes over the light source, the sheet reflects a portion of the optical energy emitted by the light source into the detector. This allows the paper sensor (240) to sense the presence of the sheet (205). Typically, paper sensor (240) is very precise and is able to determine the location of the leading edge of the paper with accuracies on the order of tens of microns.

If the sheet (205) is only being used as single sided print, the perfector arm (215) will continue to rotate in a clockwise direction and place the sheet on the exit guide (145, FIG. 1). However, if the sheet is being used to form a duplexed print, the perfector arm (215) will reverse directions and feed the trailing edge of the paper into the duplex conveyor (140). In FIG. 2D the trailing edge of the sheet (205) has been removed from the impression cylinder and is in contact with the duplex conveyor (140).

Figure 2E:
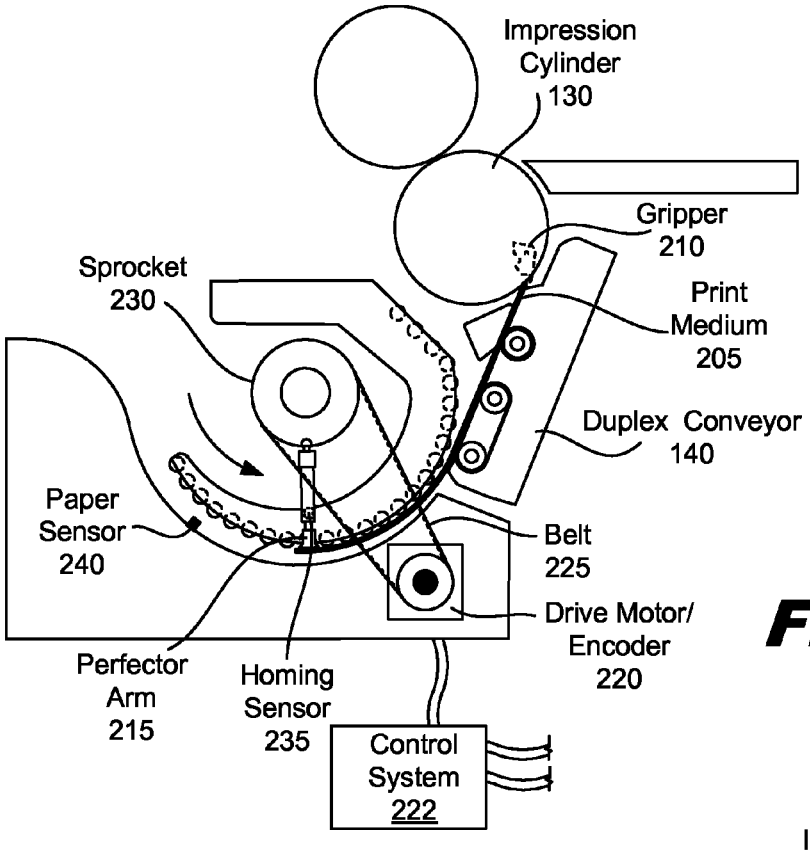
Figure 2F:
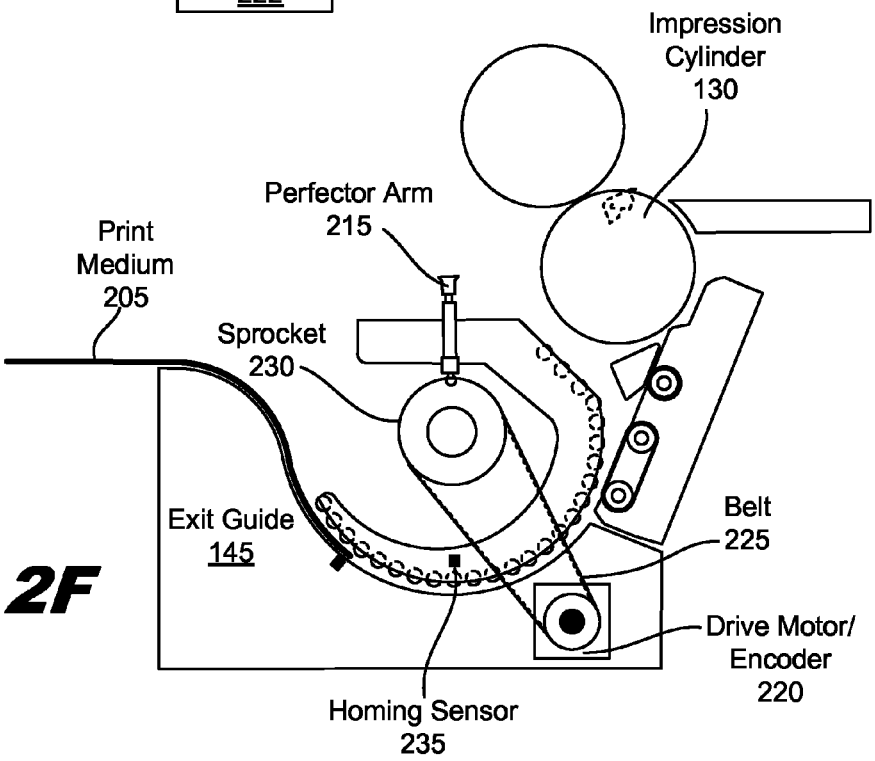

FIG. 2E shows the perfector arm (215) reversing directions to move counter-clockwise. This guides the trailing edge of the sheet (205) into the duplex conveyor (140), back toward the impression cylinder (130), and into the gripper (210). According to one illustrative embodiment, a homing sensor (235) is also included within the perfector (135, FIG. 1). In the specification and appended claims, the term "homing sensor" refers to a sensor which detects the proximity of a moving target element and produces a signal which conveys the presence of the target element in a detection zone. The homing sensor (235) could use a number of technologies to detect the proximity of the perfecter arm (215), including but not limited to optical, magnetic, electrical, contact or other sensing technology. The signal produced by the homing sensor (235) provides a position reference which can be used to calibrate and control the perfecter arm (215) motion. According to one illustrative embodiment, the perfecter arm (215) includes a tab which is position on the arm and represents the center of the suction cup. This tab triggers the homing sensor (235) which sends out an electrical signal to the control system (222). The control system (222) then records the encoder angle or counts produced by the encoder on the drive motor (220). According to one illustrative embodiment, this homing sensor (235) may be placed close to the "hand off" point between the perfecter arm (215) and the gripper (210) on the impression cylinder. The gripper (210) closes on the trailing edge of the sheet (205) and the perfecter arm (215) releases the leading edge of the sheet (205). The sheet (205) is then wrapped around the impression cylinder (130) with the printed front surface of the sheet (205) contacting the circumference of the impression cylinder (130) and the blank back surface of the sheet exposed on the outside of the cylinder. As shown in FIG. 2B, the exposed surface is brought into contact with the blanket cylinder (120) which transfers ink onto the exposed surface. After the back surface is impressed with the desired image, the sheet (205) is again removed from the impression cylinder (130) as shown in FIGS. 2C-2D. Now referring to FIG. 2F, the duplex printing process for this sheet of print media is then finished and the perfecter arm (215) moves the sheet (205) onto the exit guide (145). The exit guide (145) moves the sheet (205) into post printing processes such as image quality measurements and collation.

Figure 3A:
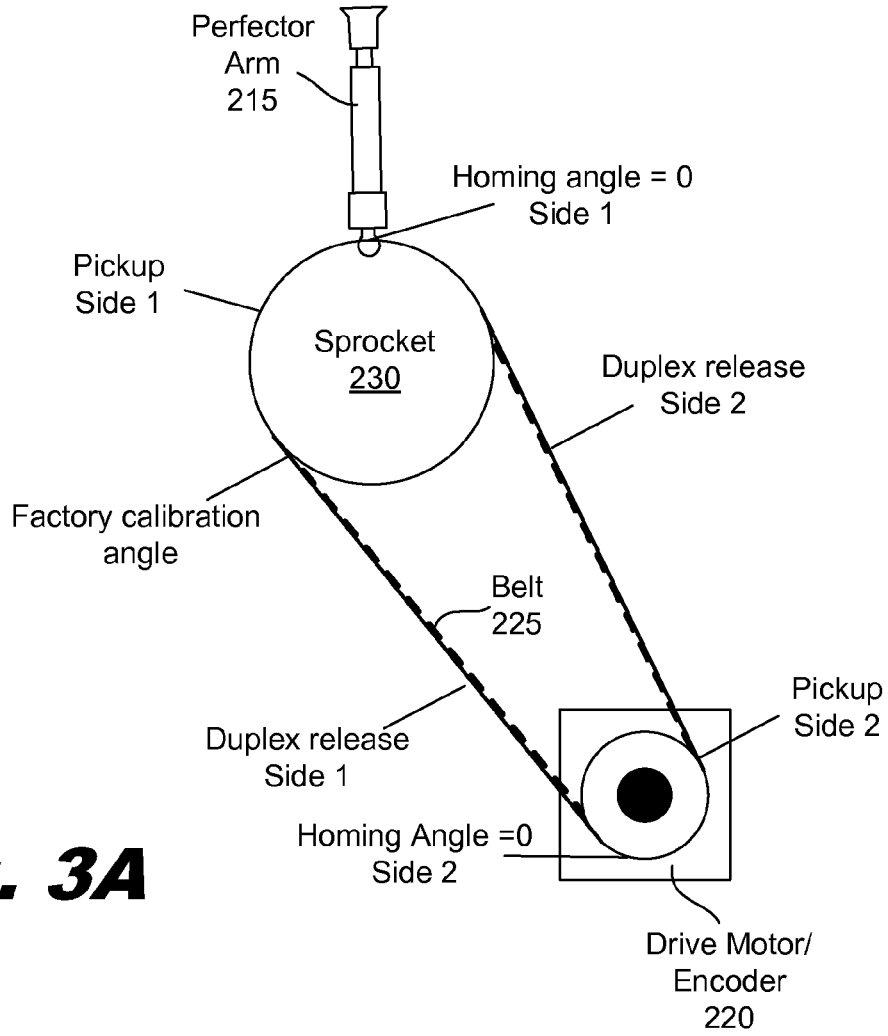
FIGS. 3A-3C are diagrams of an illustrative perfector positioning mechanism which incorporates a drive belt, according to one embodiment of principles described herein.

FIG. 3A is a diagram of the illustrative perfecter positioning mechanism which includes a drive/motor encoder (220), a belt (225), a sprocket (230) and a perfecter arm (215). While registration errors on duplexed sheets are relatively easy to measure by comparing images printed on both sides of a sheet, the cause of the registration errors is not obvious. As discussed above, a variety of components could have variations which may cause the registration errors. During the course of improving a print system, the inventors unexpectedly discovered that variations in the belt around its circumference contributed significantly to the registration error. Further, the inventors discovered that by properly appreciating the influence of the belt on the system, previously unexplained variations in the registration error could be accounted for.

As discussed above, the belt (225) may introduce an undesirable degree of error in the position of the perfecter arm (215) which results in registration errors between the front and back of a duplex print. These errors may be related to a number of characteristics of the belt (225). For example, the belt (225) necessarily has a length that is greater than the circumference of the sprocket. Consequently, the belt may be in any one of a number of orientations during the operation of the perfector. Variations in the belt (225) over its length may then introduce repeatability and accuracy errors which adversely affect the registration precision. Because of these variations, the encoder which measures rotations of the motor does not precisely correspond to the actual position of the perfecter arm.

By creating a system where one complete rotation of the belt (225) produces an integer number of rotations of the driven sprocket (230), errors produced by variation in the belt (225) may occur over shorter and repeatable cycles. According to one illustrative embodiment, the length of the belt (230) may be substantially equal to the circumference of the sprocket times an integer number. For example, the belt length may be two times the circumference of the sprocket (230). Consequently, one complete rotation of the belt (225) results in two rotations of the sprocket (230) about its axis. Various events in the duplex process (as illustrated in FIGS. 2A-2F) occur when the belt (225) is in different locations around the sprocket (230). These events are labeled on the belt (225). According to one illustrative embodiment, the perfector arm/sprocket makes one full revolution during single duplex cycle. Consequently, the belt makes a complete rotation and returns back to its original position at the beginning every other duplex cycle. For example, events "Pickup side 1" and "Homing angle=0 for side 1" are shown on one portion of the belt, while events relating to the second duplex cycle are shown over a second portion of the belt. By creating a perfector system where one rotation of the belt corresponds to an integer number of rotations of the perfecter sprocket, belt dependent calibrations can be more easily performed. For example, a first calibration could be applied during a first duplex cycle and a second calibration could be applied during a second duplex cycle. The belt has then made a complete rotation and the first calibration can then be reused on the third duplex cycle, and so forth. If one rotation of the belt does not correspond to an integer number of rotations of the perfecter sprocket, a much more complex calibration process may be required.

Figure 3B:
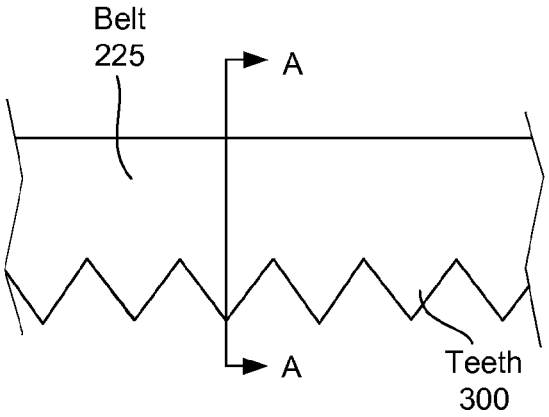

The differences in the performance of the belt (225) at the various positions can result from a number of factors. By way of example and not limitation, these factors may include variations in stiffness of the belt (225) along its length, variations in the geometric dimensions of the belt (225) or its teeth (300), variations over time, etc. FIG. 3B shows a portion of a belt (225) which has a number of teeth (300) on its lower surface. The teeth (300) may have a variety of geometries and may have variations in size, pitch, surface geometry, and other characteristics. In many situations, the teeth (300) are formed using a mold or template. This mold or template may have geometric imperfections produced as a result of wear or construction inaccuracies. These imperfections are transferred to the belt (225) and can result in undesirable variations in the performance of the perfecter mechanism.

Figure 3C:
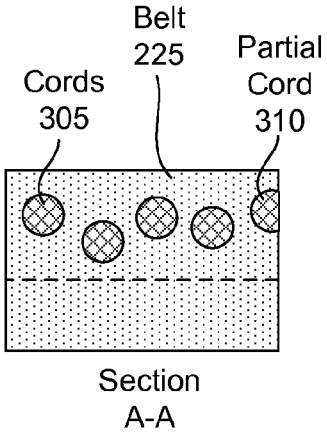

Additionally, the belt (225) is flexible so that it can conform to the diameters of the sprocket (230) and drive motor (220). In some embodiments, the flexibility is provided by molding the belt (225) out of a polymer, plastic or rubber material. FIG. 3C shows a cross-sectional diagram of a belt (225) taken along the section line A-A of FIG. 3B. A number of cords (305) can be included in the belt (225) to reduce stretching of the belt when it is placed under tension. During the manufacturing process, there may be variations in the placement and number of cords (305) around the circumference of the belt. For example, the cords (305) may be wound in a spiral around the molded teeth, then an outer polymer matrix layer is formed to encase the cords (305). The winding density, winding angle, and winding tension may all produce variations in stiffness and dimensions in a single belt or between belts. The resulting tube is then sliced perpendicular to its major axis to produce individual belts. FIG. 3C shows a partial cord (310) which has been cut during the manufacturing process. In some portions of the belt (225), the partial cord (310) may be whole and in other portions of the belt (225) the partial cord (310) may be entirely absent.

As shown in FIG. 3A, in the first duplex cycle one side of the belt is used (Duplex Release Side 1). During the next duplex cycle, the second side of the belt is used (Duplex Release Side 2). Consequently, if there are variations in the belt, there can be different position errors and registration errors for a first duplex print and a second duplex print. Because the encoder (220) is installed on the motor rather than the perfecter arm (215), the control system (222, FIG. 2E) remains unaware of the error. As a result, the illustrative system can produce two distinct populations of printed sheets, one with a population that has a registration error of "a" and another population with a registration error of "b."

Figure 4:
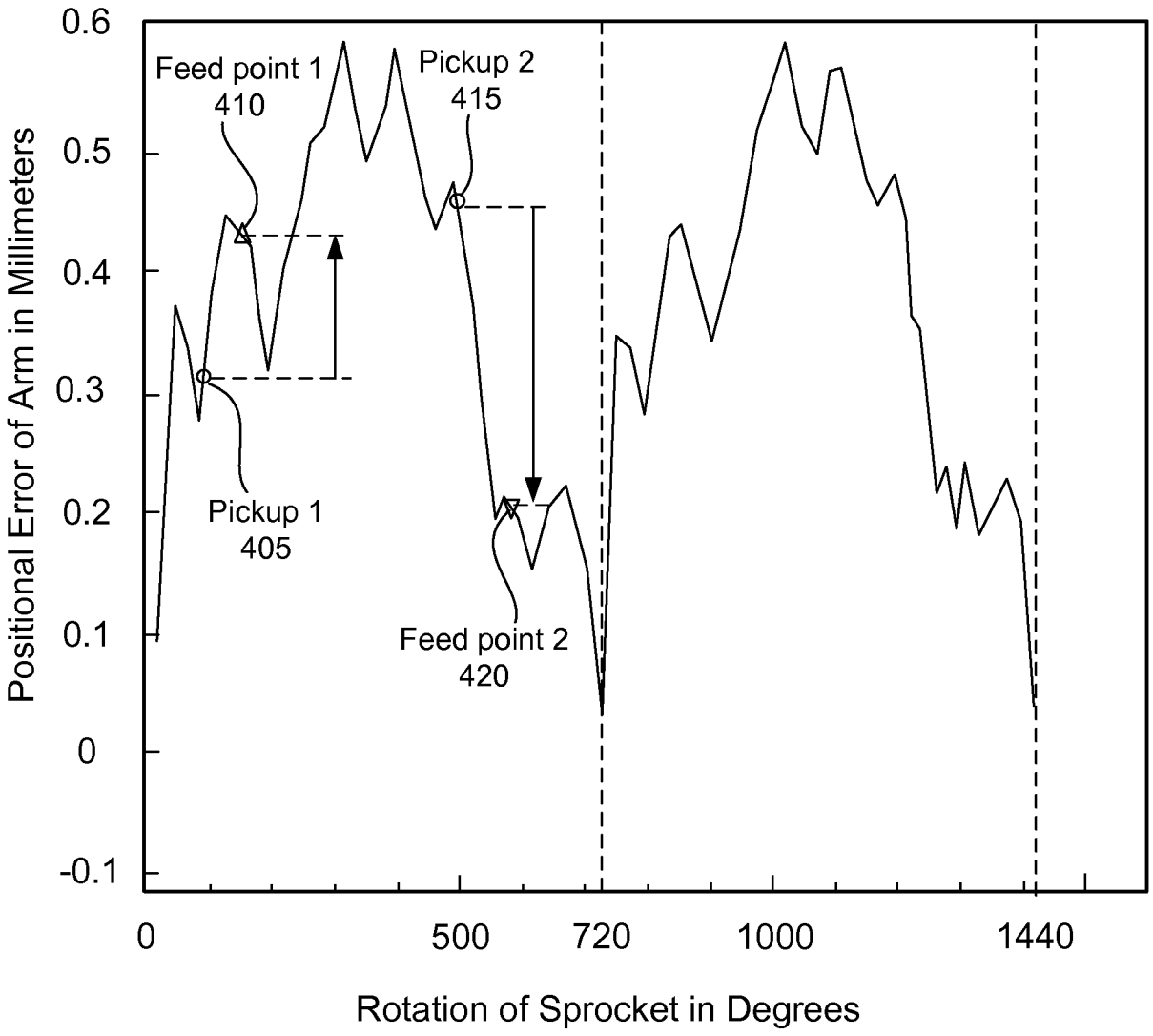
FIG. 4 is a graph showing one illustrative example of position errors produced within the perfector positioning system by a drive belt, according to one embodiment of principles described herein.

FIG. 4 is a graph showing one illustrative example of positional errors within the perfector positioning system resulting from belt variations. The vertical axis shows the positional error of the perfector arm in millimeters. As discussed above, this positional error can contribute to a corresponding registration error between the location of an image on the front side of a sheet and the location of an image on the rear side of the sheet.

The horizontal axis shows the rotation of the sprocket (230, FIG. 3A) in degrees. As can be seen from the graph, the error pattern repeats every two revolutions (every 720 degrees) of the sprocket. Two revolutions of the sprocket correspond to one complete revolution of the belt (225, FIG. 3A). Thus, the curve shown in FIG. 4 illustrates two complete rotations of the belt and four rotations of the sprocket about its axis. FIG. 4 illustrates how the positional error of the perfecter arm (215, FIG. 3A) is translated into registration errors in the duplex process. The perfecter arm picks up the front side of a first paper at pickup point 1 (405) as illustrated in FIG. 2B. At this point the perfector arm has positional error about 0.3 mm. The perfecter arm progressively moves through the positions illustrated in FIG. 2C and FIG. 2D to reach the feed point position illustrated in FIG. 2E. The feed point position of the belt is shown as feedpoint 1 (410) on the chart of FIG. 4. As used in the specification and appended claims, the term "feed point" refers to the point at which the perfector arm releases the sheet. The positional error of the arm is then about 0.45 millimeters. Consequently, the error introduced by the belt variations for this scenario is approximately 0.15 millimeters.

According to one illustrative embodiment, the perfecter arm then continues its motion through a second revolution to pick up a second sheet and follows the same process described above with respect to the first sheet. As illustrated in FIG. 4, the perfecter arm picks up the second sheet at pickup point 2 (415) and feeds the second sheet back into the duplex conveyor at feed point 2 (420). The error in making this motion is about 0.25 millimeters. The total registration error between the two sheets is the algebraic sum of the first error (0.15 millimeters) and second error (0.25 millimeters), which results in a total error of 0.4 millimeters.

In many print systems, there is a total error budget which specifies the maximum allowable error in duplex registration for all sources. For example, the total error budget may be 0.6 millimeters. To stay within this budget, all of the errors, from whatever source, must result in a shift in the image from the front to the back side of a sheet of no more than 0.6 millimeters. A variety of factors can contribute to this error, of which the belt drive mechanism is only one. For example, differences in paper size, paper thickness, encoder accuracy, drum dimensions, velocity errors, temperature differences, and other factors must all be accounted for within the 0.6 millimeter budget.

Figure 5:
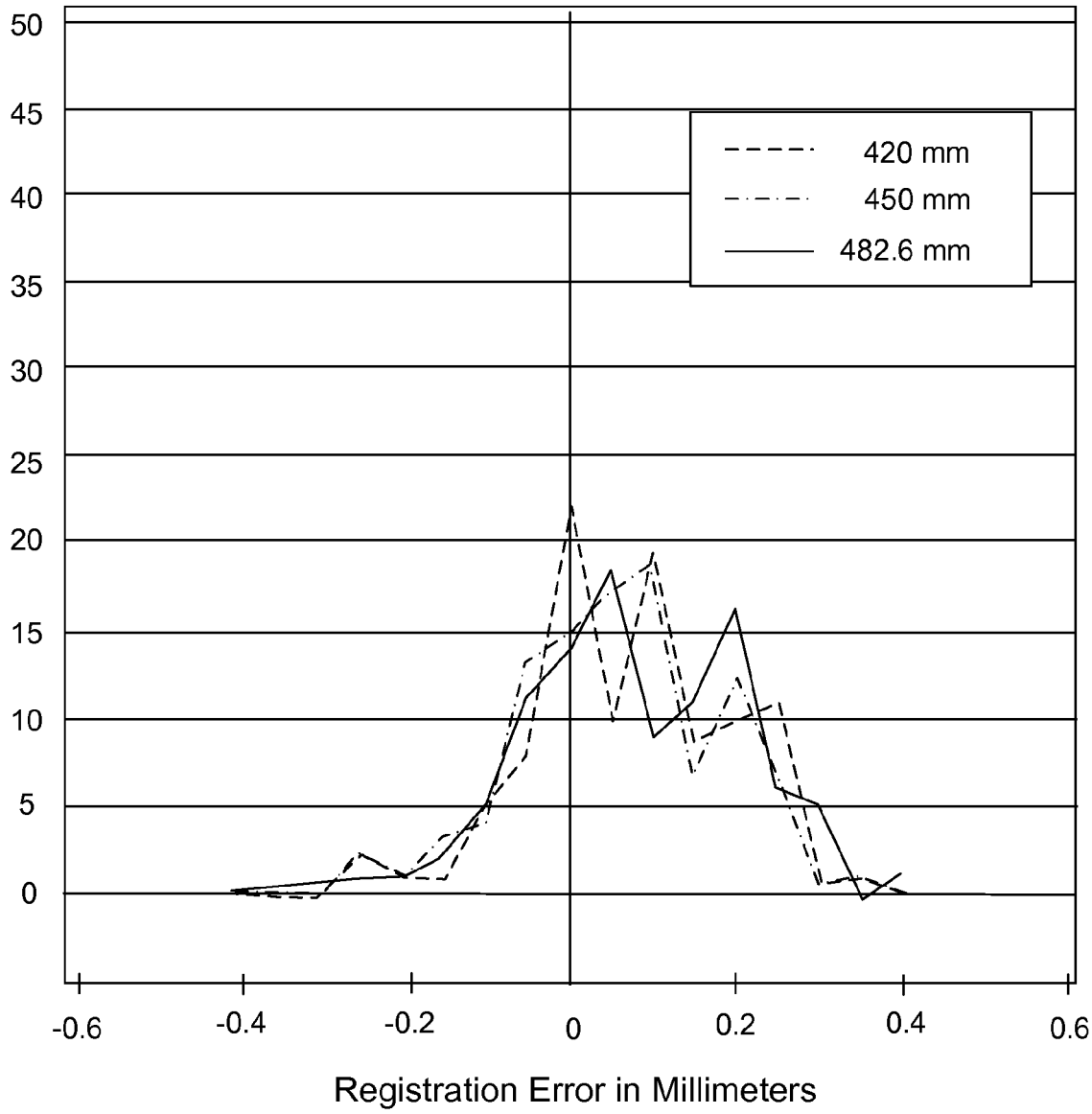
FIG. 5 is an illustrative histogram of transfer errors produced by a number of belts used within a perfector positioning system, according to one embodiment of principles described herein.

FIG. 5 shows an illustrative histogram of transfer errors produced by a number of belts which were each tested in a perfecter positioning system. Each of the fifty belts were tested with a number of paper sizes, including paper sizes that have lengths of 420 mm, 450 mm, and 482.6 mm. The horizontal axis of the chart shows the registration error in millimeters produced by each of the belts. The vertical axis represents the number of belts with the same transfer error. For example, for a paper length of 482.6 mm, approximately sixteen belts had a transfer error of 0.2 millimeters. For the same paper length, approximately eleven belts had a transfer error of −0.05 millimeters. The broad distribution of transfer errors shows that a belt error is highly variable and may, by itself, consume the majority of an error budget. The wide variations in the transfer error of the belt population can produce calibration issues when a belt is replaced. The second belt may have much different characteristics and may require recalibration to achieve the desired image quality. As can be seen from FIG. 5, a maximum error between belts could be as high as 0.6 mm. Consequently, the belt's contribution to the overall error of the system can be large portion of the total allowable error.

These irregularities can be sensed using the encoder on the motor and a homing sensor which detects the motion of the perfecter arm. For each rotation or cycle, the change in encoder counts between homing sensor pulses can be used to quantify the error or deviation. Using this information, the motor position can be corrected to produce the desired perfector arm position.

Figure 6:
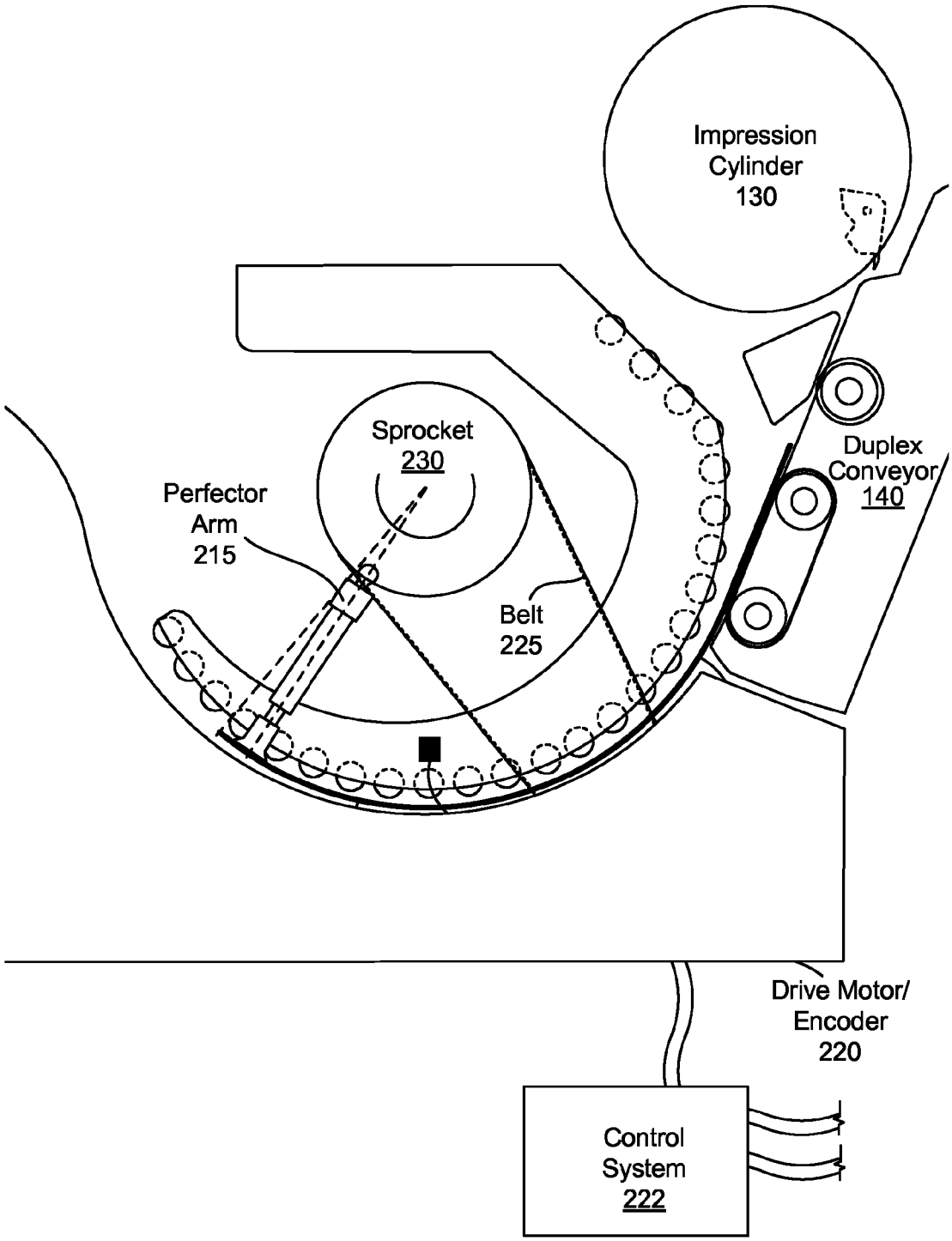
FIG. 6 is a diagram of the illustrative perfector positioning system which incorporates error correction, according to one embodiment of principles described herein.

FIG. 6 is a diagram of the illustrative perfector positioning system incorporating error correction. As discussed above, the perfector mechanism has at least two characteristics which may contribute to registration errors. These errors may be detected using carefully positioned sensors, an understanding of how the belt contributes to the errors, and an understanding of the characteristics of the belt drive system.

The first characteristic of the perfecter mechanism that may contribute to registration errors is imperfections in the belt (225). These imperfections can be partially corrected by using the following homing sequence. During the homing sequence, the control system (222) uses the first index of the homing sensor (235) to set the absolute position of the arm (215) at a first encoder position. The arm (215) is then rotated around one revolution and the homing sensor (235) again senses the arm (215) as it passes. The actual number of encoder counts required for the perfecter arm (215) to make one full revolution is then recorded. The actual encoder counts are differenced with the expected number of encoder counts to create a position error. The control system (222) then accounts for this position error during the motion of the perfector arm. This can improve the accuracy of the arm (215) position during the duplexing operation.

A similar calibration can be performed during the second rotation of the perfector arm which corresponds to the second portion of the belt. As discussed above, the errors on the second side of the belt can be significantly different than the errors generated by the first side of the belt. Consequently, separate calibrations for the two rotations of the perfector arm can be generated and the control system (222) can be configured to apply desired calibration during the corresponding rotation of the perfector arm.

Additionally, this calibration and monitoring of the perfector arm can be useful to correct for errors in real time. According to one illustrative embodiment, this calibration routine can be performed during each of the rotations of the perfecter arm during the duplex process. This can correct for changes in the belt or other time dependent factors. For example, belt characteristics can change over time as a result of thermal changes within the system, wear, stretch, etc. A sudden change in the encoder count difference or the encoder counts exceeding a limit can point to a faulty belt or undesirable belt tension.

A second characteristic of the perfector mechanism that may contribute to registration errors is the pickup error. As discussed above with respect to FIG. 2B, a number of factors can contribute to pickup errors. Errors in arm position and pickup errors can result in improper positioning of the sheet (205) in preparation for printing on the second side of the sheet (205). According to one illustrative embodiment, and with continued reference to FIG. 6, an existing homing sensor (235) was repositioned near the feedpoint where the perfecter arm releases the sheet to be fed by the duplex conveyor (140) back onto the impression cylinder (130). A paper sensor (240) is positioned at the maximum extent of the sheet travel during the duplex process. As discussed above, the homing sensor (235) can detect the presence of the perfecter arm (215) with a high degree of accuracy and the paper sensor (215) can detect the leading edge of the sheet with a high degree of accuracy. After the perfecter arm (215) picks up the sheet (205) off the impression cylinder (130), it rotates clockwise and passes the homing sensor (215). The control system (222) senses the arm's presence using the homing sensor (215) and can accurately update to the position of arm stored in the control system memory. As discussed above, this can help compensate for positional errors related to belt flaws. The arm (230) then continues to move the sheet to the left until the paper sensor (215) senses the leading edge of the sheet. At this point, the angle $\alpha_{sc}$ can be determined. The angle $\alpha_{sc}$ represents the suction cup margin, or the distance between the centerline of the suction cup at the end of the perfecter arm (215) and the leading edge of the paper (240). The updated position of the perfector arm (215) is used to provide one reference line and the paper sensor provides the other reference line for the calculation of the angle $\alpha_{SC}$.

The calculation of the angle $\alpha_{sc}$ is an independent measurement of the paper position with respect to the perfector arm (215) which is decoupled from all previous actions. The actual suction cup margin can be compared to the desired suction cup margin and corrective action can be taken to compensate for errors between the actual and desired suction cup margins. Consequently, as the perfecter arm (215) reverses its motion, feeds the sheet (205) into the duplex conveyor (140) and releases the sheet (205), the accumulated errors can be corrected. According to one illustrative embodiment, the perfector arm (215) releases the paper shortly after encountering the homing sensor (235) for a second time. This provides a second confirmation of the position of the perfecter arm (215) just before the release of the sheet (205).

The second calibration routine incorporates the paper sensor (240). For example, the actual suction cup margin may be calculated in encoder counts. The desired number of encoder counts can be differenced from the actual suction cup margin. Deviations of the suction cup margin from the optimum are, in fact, pickup errors of the system. This error is then fed into the control system (222), which corrects for the error. In this way, the pickup error can be corrected on a sheet-by-sheet basis.

In some printing systems, there may be two independent perfecter arm mechanisms which cooperate to improve the throughput of the printing system. According to one illustrative embodiment, each of the perfector arm mechanisms use separate motors/encoders, belts, sensors, and sprockets, which allows for independent motion of each arm. If a first perfecter arm A and a second perfector arm B are used, arm A picks up the to-be-duplexed sheet and feeds it again while arm B picks up the next sheet. While arm B feeds the sheet back, arm A picks up the duplexed sheet and exits it. Arm A then picks up the next to-be-duplexed sheet and arm B exits the already duplexed sheet. By working cooperatively, the efficiency of the printing system is improved. However, in printing systems with multiple perfecter arms, it can become increasingly important to compensate for registration errors so that differences between the sheets duplexed by arm A do not have a significantly different registration from those duplexed by arm B.

Figure 7:
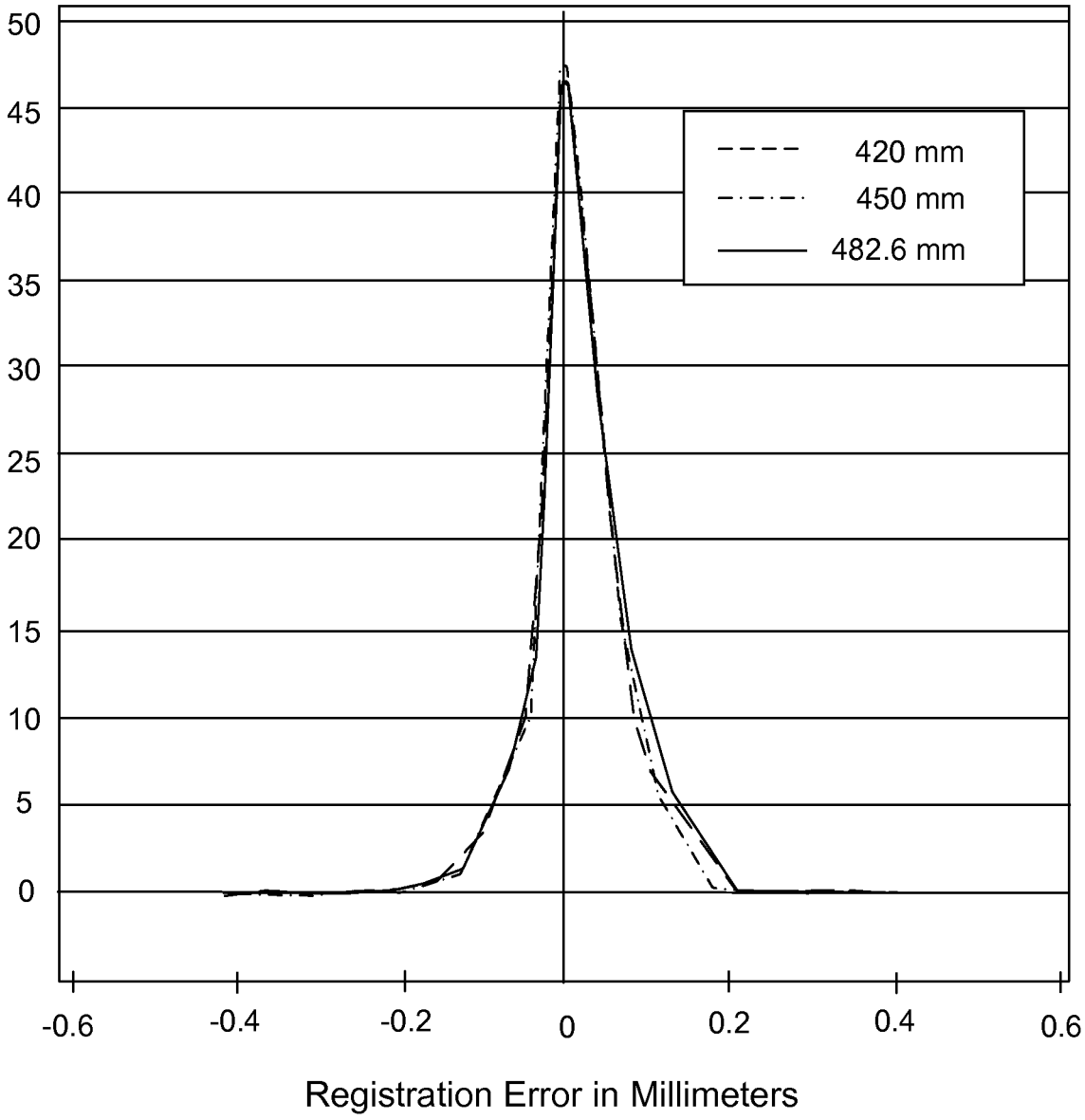
FIG. 7 is an illustrative histogram of registration errors produced by a number of belts used within a perfector positioning system which implements an illustrative error correction system, according to one embodiment of principles described herein.

FIG. 7 is a histogram of transfer errors produced by a number of belts used within a perfector positioning system implementing the illustrative error correction systems and methods. Similar to the graph shown in FIG. 5, the horizontal axis of the chart shows the registration error in millimeters produced by each of the belts. The vertical axis represents the number of belts which exhibited the same transfer error. The graph for each of the paper lengths shows that the transfer errors have a much tighter distribution which is centered about the zero error value. The maximum error between belts is expected to be approximately 0.2 mm or less.

Figure 8:
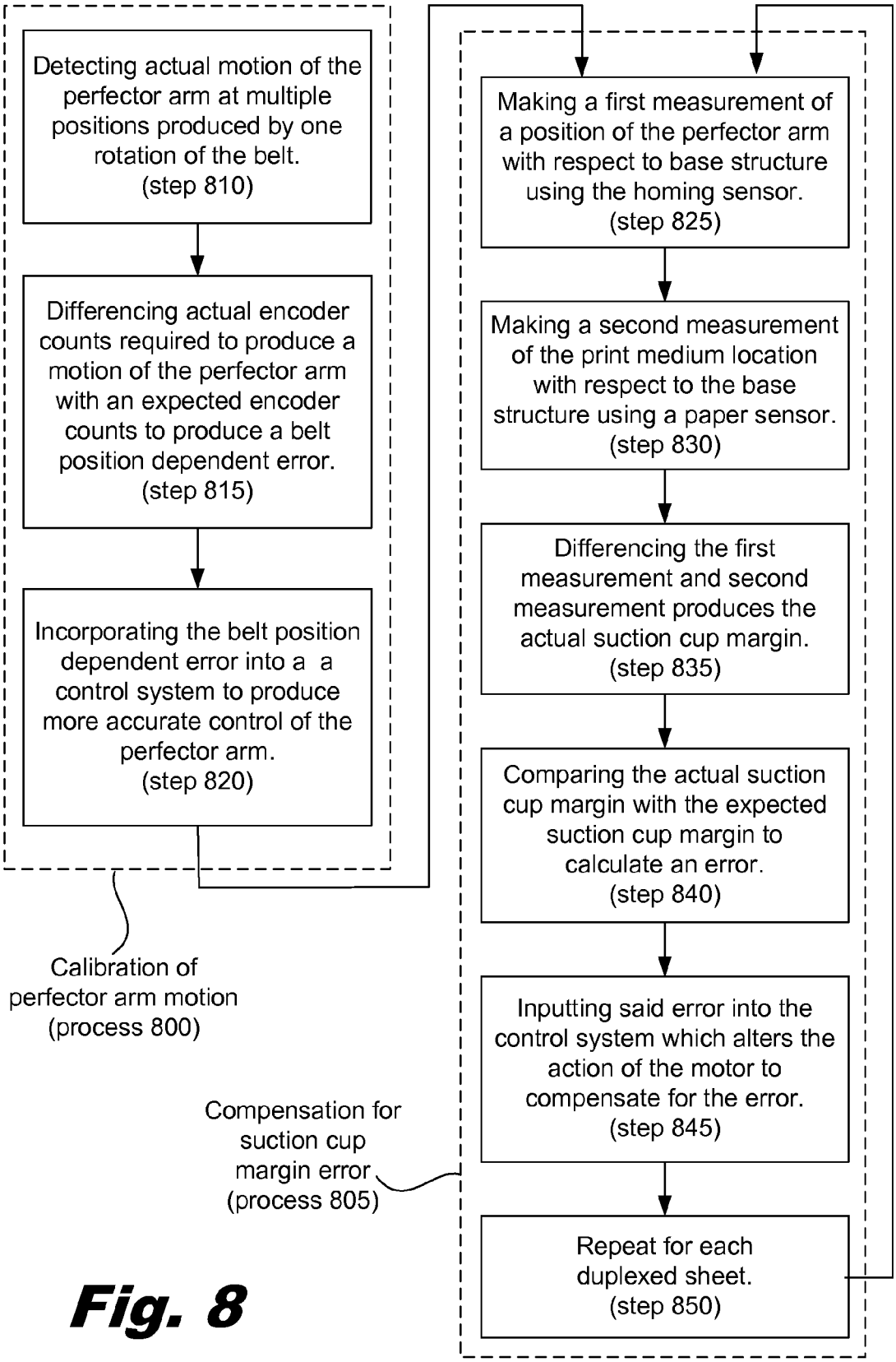
FIG. 8 is an illustrative method for increasing the precision of a duplex printing system, according to one embodiment of principles described herein.

FIG. 8 is an illustrative method for increasing the precision of a duplex printing system. According to one illustrative embodiment, an initial calibration of the perfector arm motion (process 800) is performed. This increases the overall accuracy of the system in positioning the perfecter arm. Then, for each sheet that is duplexed, the system measures and attempts to compensate for any suction cup margin error which remains (process 805).

According to one illustrative embodiment, the initial calibration of the perfecter arm motion (process 800) may include a first step of detecting actual motion of the perfector arm at multiple positions produced during one rotation of the belt (step 810). This may be accomplished using a homing sensor which is strategically placed in travel of the perfector arm to increase the accuracy of calibration at locations where the perfecter arm performs an action, such as the pickup point or the feed point. Next, differencing the actual encoder counts required to produce the motion of the perfecter mechanism with the expected encoder counts produces a measure of the error in the perfecter arm position (step 815). By way of example and not limitation, the control system could expect that it would require 10,000 encoder counts of the motor encoder to produce a first revolution of the perfecter arm. However, due to belt variations or other inaccuracies, the first revolution of the perfector arm may require 10,030 encoder counts to complete a first revolution past the homing sensor. This produces an error of 30 encoder counts. For example, the belt may have stretched slightly during the motion. In the second revolution, the actual encoder counts may be 9,950, producing an error of −50 encoder counts. These belt position dependent errors are fed into the control system so that it can compensate for the errors and produce more accurate perfecter arm motion (step 820).

Following the calibration of the perfecter arm motion through one rotation of the belt, a process for compensating for suction cup margin error (process 805) can be performed. A first step may include making a first measurement of a position of the perfector arm (step 825). Then a second measurement can be made of the sheet location which respect to the base structure using a paper sensor (step 830). Differencing the first measurement and second measurement produces the actual suction cup margin (step 835). The actual suction cup margin may be expressed in a variety of ways including an angle, a distance, or encoder counts. Comparing the actual suction cup margin with the expected suction cup margin produces an error measurement (step 840). This error measurement is input into the control system which alters the action of the motor or other actuators to compensate for the error (step 845). This process can be repeated for each duplexed sheet (step 850).

In sum, moving the homing sensor to a more optimum location and incorporating the calibration routines described above allows for the correction of errors within a high precision positioning device. Further, this implementation can be very low cost when existing hardware is simply reconfigured to make better use of sensors. Additionally, this method continuously calibrates and corrects component motion to correct for variation in the characteristics of the belt or system over time. This improves the performance of the system and could reduce maintenance costs.

The preceding description has been presented only to illustrate and describe embodiments and examples of the principles described. This description is not intended to be exhaustive or to limit these principles to any precise form disclosed. Many modifications and variations are possible in light of the above teaching. For example, these principles could be applied to a number of high precision systems which incorporate belt-driven mechanisms, such as belt-driven print heads or paper feeding mechanisms.

What is claimed is:

1. A method of error correction in a printing system, said method comprising:

engaging a sheet of print media with a rotating perfector arm, wherein said perfector arm is rotated by a belt which is driven by a motor;

detecting a relative position of said perfector arm with respect to said sheet of print media when said perfector arm has engaged said sheet of print media, said detecting being performed using a homing sensor that is configured to sense said perfector arm while said perfector arm is engaged with said sheet of print media;

comparing said relative position of said perfector arm, as indicated by said homing sensor, with an expected relative position between said perfector arm and said sheet of print media, said expected relative position being determined by an encoder which is encoding a position of said motor, a difference between said relative position and said expected relative position of said perfector arm being attributable to said belt; and when feeding said sheet of print media with said perfector arm to a print engine, compensating for any difference between said relative position and said expected relative position by adjusting a position of said motor.

2. The method of claim 1, wherein a length of said belt equals a circumference of a sprocket on said motor that drives said belt times an integer number.

3. The method of claim 2, further comprising driving said perfector arm an integer number of rotations for each rotation of said belt.

4. The method of claim 3, further comprising performing an independent calibration, by repeating said detecting, comparing and compensating, for each of said integer number of rotations of said perfector arm.

5. The method of claim 1, in which said detecting of said relative position of said perfector arm with respect to said sheet further comprises:

sensing said perfector arm with said homing sensor and recording a corresponding first encoder count of a drive motor coupled to said perfector arm;

sensing a leading edge of said sheet of print media and recording a corresponding second encoder count of said drive motor; and differencing said first encoder count and said second encoder count to produce said relative position of said perfector arm with respect to said sheet of print media.

6. A method of error correction in a duplex printing system comprising:

performing a calibration of a perfector arm with respect to a base structure, said calibration comprising:

detecting motion of said perfector arm using a homing sensor, wherein an integer number of rotations of said perfecctor arm correspond to one rotation of a belt, said belt connecting said perfector arm to a drive motor having an encoder; and differencing an actual position of said perfector arm as indicated by said homing sensor with a position of said perfector arm as indicated by an encoder count from said encoder to produce a belt position dependent error; and compensating for said belt position dependent error when feeding a sheet of print media with said perfector arm in said duplex printing system.

7. The method of claim 6, further comprising making a measurement of a position of said perfector arm with respect to said base structure using said homing sensor positioned to sense said perfector arm while said perfector arm is engaged with said sheet of print media;

making a measurement of a location of said sheet of print media with respect to said base structure;

differencing said measurement of said position of said perfector arm and said measurement of said location of said sheet of print media to produce a relative positioning relationship between said perfector arm and said sheet of print media;

comparing said relationship to an expected relationship to find an error; and inputting said error into a control system, said control system altering an action of said drive motor to compensate for said error.

8. A duplex printing system comprising:

an impression cylinder configured to hold a sheet of print media on a surface of said impression cylinder;

a perfector arm, said perfector arm being configured to engage said sheet of print media, remove said sheet of print media from a surface of said impression cylinder, and reposition said sheet of print media on said impression cylinder such that an opposite side of said sheet of print media is presented for printing, said perfector arm being connected to a drive motor by a belt, said drive motor being configured to control motion of said perfector arm, wherein a sprocket of said drive motor has a circumference equal to a length of said belt divided by an integer number, such that a number of rotations of said sprocket equal to said integer number corresponds to one rotation of said belt;

a homing sensor configured to detect passage of said perfector arm while said perfector arm is engaged with said sheet of print media; and a control system configured to accept output signals from said homing sensor and an encoder attached to said drive motor; said control system being further configured to use said output signals to calibrate said motion of said perfector arm through a motion corresponding to one rotation of said belt.

9. The system of claim 8, in which one rotation of said belt results in motion of said perfector arm through an integer number of rotations.

10. The system of claim 8, wherein said control system is configured to control said drive motor to adjust motion of said perfector arm based on both of said output signals from said homing sensor and said encoder attached to said drive motor.

11. The system of claim 8, further comprising a paper sensor, said paper sensor being configured to detect a leading edge of said sheet of print media during duplexing of said sheet of print media.

12. The system of claim 11, further comprising a control system configured to accept output from said homing sensor and said paper sensor and calculate an actual suction cup margin.

13. The system of claim 12, in which said control system is further configured to compare said actual suction cup margin to an expected suction cup margin to produce an error, said control system compensating for said error by controlling said drive motor.

14. The system of claim 11, in which said paper sensor and said homing sensor are optical sensors.

15. The system of claim 8, further comprising an additional perfector arm configured to operate in tandem with said perfector arm to increase throughput of said duplex printing system.

16. The method of claim 1, further comprising driving rotation of said perfector arm with a continuous belt on a sprocket, wherein said sprocket has a circumference equal to a length of said belt divided by an integer number, such that a number of rotations of said sprocket equal to said integer number corresponds to one rotation of said belt.

17. The method of claim 1, further comprising applying a first calibration factor to movement of said perfector arm during a first duplexing operation and applying a second different calibration factor to movement of said perfector arm during a second duplexing operation, wherein said first and second duplexing operations corresponding to one complete rotation of said belt that drives said perfector arm.

18. The method of claim 6, further comprising driving rotation of said perfector arm via said belt with a sprocket of said drive motor, wherein said sprocket has a circumference equal to a length of said belt times an integer number, such that a number of rotations of said sprocket equal to said integer number corresponds to one rotation of said belt.

19. The method of claim 6, further comprising applying a first compensating factor to movement of said perfector arm during a first duplexing operation and applying a second different compensating factor to movement of said perfector arm during a second duplexing operation, wherein said first and second duplexing operations corresponding to one complete rotation of said belt that drives said perfector arm.

20. The method of claim 8, further comprising a control system for applying a first compensating factor to movement of said perfector arm during a first duplexing operation and applying a second different compensating factor to movement of said perfector arm during a second duplexing operation, wherein said first and second duplexing operations corresponding to one complete rotation of said belt that drives said perfector arm.

* * * * *

UNITED STATES PATENT AND TRADEMARK OFFICE

CERTIFICATE OF CORRECTION

PATENT NO. : 8,839,718 B2
APPLICATION NO. : 12/410814
DATED : September 23, 2014
INVENTOR(S) : Ittai Wiener et al.

It is certified that error appears in the above-identified patent and that said Letters Patent is hereby corrected as shown below:

In the claims

In column 11, line 54, in Claim 6, delete "perfecctor" and insert -- perfector --, therefor.

Signed and Sealed this
Seventh Day of June, 2016

Michelle K. Lee

Michelle K. Lee
*Director of the United States Patent and Trademark Office*